United States Patent [19]

Bialick

[11] Patent Number: 4,864,620

[45] Date of Patent: Sep. 5, 1989

[54] METHOD FOR PERFORMING TIME-SCALE MODIFICATION OF SPEECH INFORMATION OR SPEECH SIGNALS

[75] Inventor: Leonid Bialick, Rishon-Le-Zion, Israel

[73] Assignee: The DSP Group, Inc., Emeryville, Calif.

[21] Appl. No.: 151,852

[22] Filed: Feb. 3, 1988

[30] Foreign Application Priority Data

Dec. 21, 1987 [IL] Israel ..... 84902

[51] Int. Cl.[4] ..... G10L 5/00

[52] U.S. Cl. ..... 381/34; 381/51; 364/513.5

[58] Field of Search ..... 381/34, 51; 364/513.5

[56] References Cited

U.S. PATENT DOCUMENTS 4,022,974 5/1977 Kohut et al. .
4,209,844 6/1980 Brantingham et al. .
4,406,001 9/1983 Klasco et al. .
4,435,832 3/1984 Asada et al. .

OTHER PUBLICATIONS

Rabiner, L. R./Schafer, R. W., "Digital Processing of Speech Signals", Prentice Hall Signal Processing Series, Oppenheim, Editor, (1978) pp.149–158.

IEEE Proceedings on Acoustics, Speech, and Signal Processing, Mar. 26–29, 1985, Tampa, Florida, vol. 2 of 4.

Salim, Roucos and Wilgus, Alexander M., "High Quality Time-Scale Modification for Speech", pp. 493–496. IEEE Proceedings on Acoustics, Speech, and Signal Processing, Apr. 7–11, 1986, Tokyo, Japan, vol. 3 of 4.

Makhoul, John and El-Jaroudi, Amro, "Time-Scale Modification in Medium to Low Rate Speech Coding", pp. 1705–1708.

*Primary Examiner*—Emanuel S. Kemeny

*Attorney, Agent, or Firm*—Townsend and Townsend

[57] ABSTRACT

Pre-recorded speech is played back at a different rate, without pitch change. Adjacent signal segments are combined with best match processing. Method and apparatus process time domain speech signals containing speech information, the rate of reproduction of which is to be varied without changing pitch, wherein the input signal is processed by capturing input time domain speech samples in frames wherein the number of samples per frame is a function of a desired speech change factor, forming blocks from the frames, additively cross correlating input blocks with prior-processed or output blocks, preferably by means of an Average Magnitude Difference Function, to obtain a time relation of best match for the rate of reproduction, adding consecutive input and output blocks at the point of maximum correlation, and applying a window function between the overlapping portions of the output block and the input block to obtain a new output block. The method does not require multiplication or division. Relatively smooth transitions between superimposed segments of speech which become output blocks are realized by applying a graduated weighting.

9 Claims, 3 Drawing Sheets

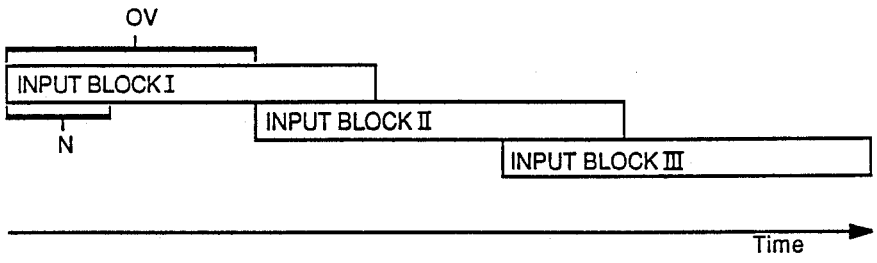
FIGURE 3A
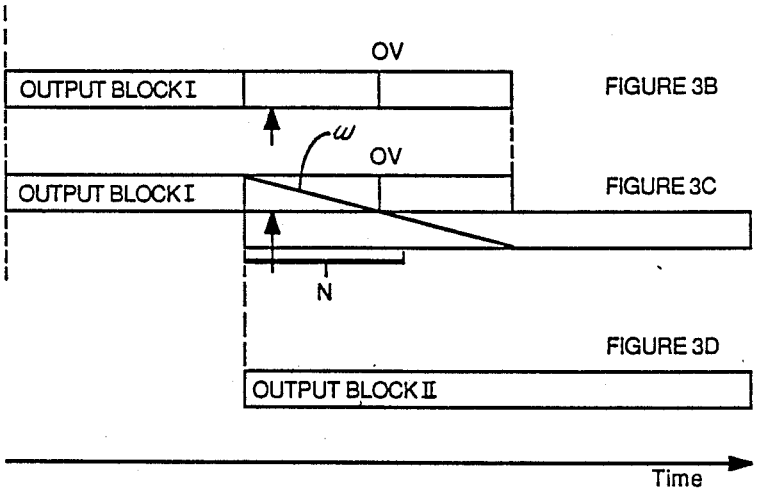

METHOD FOR PERFORMING TIME-SCALE MODIFICATION OF SPEECH INFORMATION OR SPEECH SIGNALS

BACKGROUND OF THE INVENTION

This invention relates to digital signal processing and more particularly to time domain digital speech processing in order to vary the rate of reproduction of speech without changing pitch.

In recent years various techniques have been developed for achieving time compression/expansion of audio information, particularly speech information. In order to utilize time compression or expansion effectively, where the compression or expansion factor is significant, some mechanism is necessary to correct for changes in pitch which would normally follow a direct application of acceleration or deceleration techniques. Acceleration or deceleration of recorded speech is easily achieved by speeding or slowing the rate of reproduction, which in turn raises or lowers pitch, as is expected.

Time compression and expansion of speech is useful in many applications. Time compression allows matching of speech information to a desired playback time. Time expansion is particularly useful for example, in dictation equipment to speed up playback or in foreign language learning situations to slow down playback to improve comprehension, which may be difficult or otherwise impaired.

Numerous techniques have been developed to achieve time compression and/or expansion, particularly techniques which manipulate analog signal representations. Of the various prior art techniques, the following patents or publications are representative:

Roucos and Wilgus, "High Quality Time-Scale Modification for Speech," ICASSP 85. *Proceedings of the IEEE International Conference of Acoustics, Speech, and Signal Processing,* pp. 493–6, Volume 2, 1985 (26–29 March 1985), IEEE. This relatively recent paper represents a development in the algorithms for reproducing speech using digital techniques. The research group is Bolt, Beranek & Newman Inc. of Cambridge, Mass.

Makhoul, J. and El-Jaroudi, "Time-Scale Modification in Medium to Low Rate Speech Coding," ICASSP 86. *Proceedings of the IEEE International Conference of Acoustics, Speech, and Signal Processing* pp. 1705–1708, Volume 3, 1986, (Apr. 7–11, 1986), IEEE. This paper produced by the same research group related to the foregoing describes further development in digital signal processing techniques for rate modifying speech.

These two papers relate to description and implementation of the synchronous-overlap-and-add method of time-scale modification. The algorithm described therein allows arbitrary linear or nonlinear scaling of the time axis using a modified overlap-and-add procedure operating on the time domain waveform. The Makhoul paper describes the implementation of a technique involving generalized cross-correlaton between a normalized source signal (y(n)) and a normalized derived signal (x(n)). The technique was originally described in the Roucos paper.

Asada et al., U.S. Pat. No. 4,435,832 issued Mar. 6, 1984, to Hitachi, describes a speech synthesizer wherein LPC (linear predictive coding) techniques are employed to synthesize speech. Control is exercised over the rate of speech by lengthening or shortening the time interval of interpolation between the fetching of each of the LPC parameters to synthesize the speech. This technology is essentially unrelated to the present invention, since the present invention is unrelated to synthesized speech or parametrically-defined speech.

Klasco et al., U.S. Pat. No. 4,406,001 issued Sept. 20, 1983, to The Variable Speech Control Company of San Francisco, describes a time compression/expansion audio reproduction system of the type which relies on analog circuitry. It provides speech correction by repetitive variable time delay achieved by separating the reproduced signal from a recording into components which are separately delayed. The signal is separated into contiguous frequency bands, each of which is delayed synchronously. The signal is then recombined after delay, and low-pass filtering techniques are employed to remove high-frequency components introduced into the speech components by the signal processing technique. This technology is readily distinguishable from the present invention for at least two reasons. First, this technology relies on analog methods, whereas the present invention is digital in nature. Second, the present invention does not require filtering of speech components. Other distinctions will also be apparent to those of ordinary skill in this art.

Brantingham et al., U.S. Pat. No. 4,209,844, issued June 24, 1980, to Texas Instruments, describes a digital filter technique using a form of linear predictive coding (LPC). Specifically, the patent describes an invention embodied in a device implementing a lattice-type filter for generating complex waveforms suitable for implementation in semiconductor device technology. The invention appears to be unsuited to time-domain speech processing and further is not applicable to time scale modification in the time domain.

Kohut et al., U.S. Pat. No. 4,022,974, issued May 10, 1987, to Bell Telephone Laboratories, describes a predictive speech synthesizer having the capability of varying speech without changing pitch. The Bell technique is substantially unrelated to the present invention, since it relates primarily to parametric speech and does not deal with a actual time domain speech signal.

What is needed is a simple yet effective digital technique for providing time scale modification of real time or near real time speech signals.

SUMMARY OF THE INVENTION

According to the invention, method and apparatus are provided to process time domain speech signal containing speech information, the rate of reproduction of which is to be varied without changing pitch. The basic process comprises superimposing partially overlapping blocks of speech samples in a manner such that the pitch periodicity is maintained. The extent of superimposition is a function of the desired increase or decrease , or variance, in the time scale of the speech. In accordance with a preferred embodiment of the invention, maintenance of speech periodicity is achieved by fixing the precise superimposition in the time domain such that the superimposed waveforms achieve a best match using a technique which does not require multiplication or division.

Relatively smooth transition between superimposed speech signals are realized by applying a graduated weighting thereto.

In accordance with a preferred embodiment of the invention, if the extent of superimposition exceeds the amount of overlap, an accelerated speech output is provided, and if the extent of superimposition is less than the amount of overlap, a decelerated speech output is provided.

To minimize required computational load, the search range, that is, the range over which superimposition is varied in order to achieve a best match between speech segments, is selected as a function of pitch, thus ensuring that a sufficient number of samples are taken to assure that pitch pulses are contained in a sample set without requiring superfluous computations.

A specific embodiment of the invention allows for speech expansion of up to 150% and speech compression to as little as 40% of the duration of the source.

The method according to the invention may be incorporated into an embodiment using programmable digital signal processing hardware, such as a Texas Instruments TMS 320 Series device. Therefore it is not necessary to describe such devices in detail, since the combination of such components with programs in general are known to those of skill in the art. The application of such devices in accordance with the invention is nevertheless not apparent from the devices.

The method in accordance with the invention is substantially simpler, faster and more efficient than other methods which might be considered for purposes similar to the intended application. As one consequence, the method in accordance with the invention is more easily adapted to implementation in Very Large Scale Integration (VLSI) technology.

The method in accordance with the invention makes use of a waveform-segments-matching technique which takes advantage of the periodic nature of the signals produced by speech, and more specifically the existence of pitch pulses within a speech signal. Hence, in accordance with the invention, use is made of the maximum value of the pitch period of the input speech to reduce complexity, a technique not used heretofore.

The invention will be better understood by reference to the following detailed description in connection with the accompanying drawings.

DESCRIPTION OF DRAWINGS

FIGS. 3A through 3D are illustrations showing operation of the method and apparatus according to the invention.

DESCRIPTION OF A PREFERRED EMBODIMENT

Figure 1:
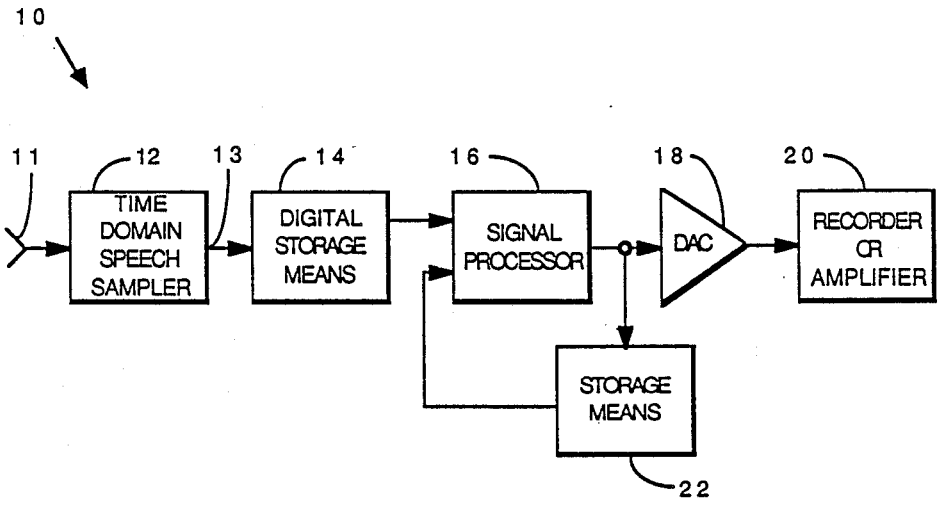
FIG. 1 is a block diagram of a device which operates in accordance with the invention.

Referring to FIG. 1, a block diagram is shown of a signal processing apparatus 10 illustrating a typical environment of apparatus in accordance with the invention. Many variations will be apparent to those of ordinary skill in this art, including such variations as to the type of input devices and output components.

In the illustrative embodiment, the signal processing apparatus 10 includes a time-domain speech sampling means 12, the input port 11 of which receives live real-time or substantially real-time analog speech signals, and the output port 13 of which is coupled to digital storage means 14, such as a computer memory or set of digital storage registers. The digital storage means 14 has a digital signal output which is coupled to a digital signal processing means 16, such as a microcomputer constructed around a programmable microprocessor or special purpose digital signal processing device.

A suitable microprocessor is a Motorola 68000 series microprocessor or a Texas Instruments TMS 32020 DSP Chip preprogrammed to receive digital input data temporarily stored in the digital storage means 16, to process the digital input data in accordance with the method of the invention and to provide as a digital output signal digital output data to an output means such as a digital-to-analog converter means 18.

The digital-to-analog converter means 18 reconstructs an analog signal for audio reproduction and therefore has an output terminal which is coupled to an audio amplifier means 20 or the like, such as an analog recorder. In addition, output of the digital signal processor 16 is provided to interim storage means 22 which provides a second input to the digital signal processing means 16 for use in comparing the resultant digital output with subsequently received speech segments (frames or portions of frames) as explained hereinbelow.

Figure 2:
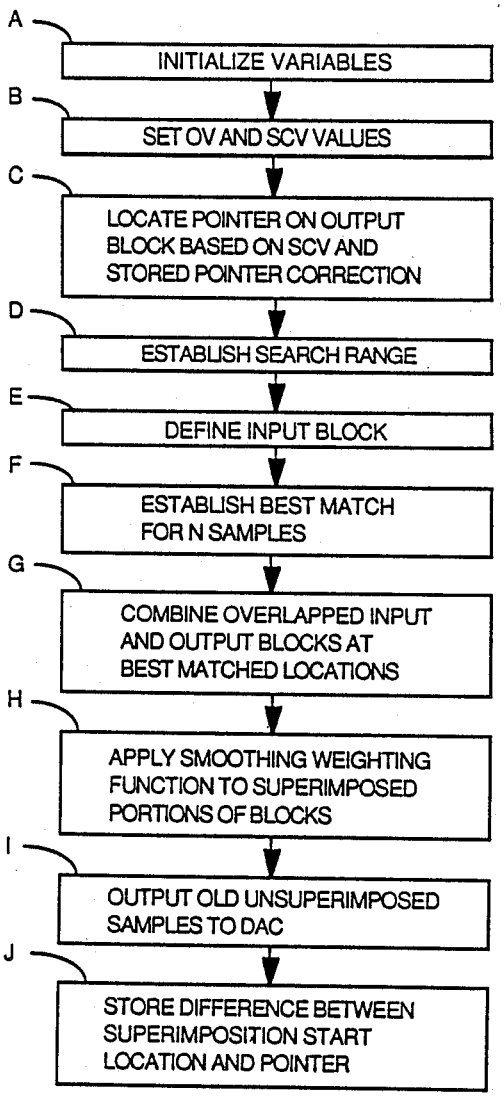
FIG. 2 is a flow chart of a method in accordance with the invention.

Referring to FIG. 2, there is shown a flow chart for the relevant portion of a computer program for processing digitized input speech information in accordance with the invention. FIGS. 3A–3D, which are to be viewed as one diagram in connection with FIG. 2, illustrate the time relationship among block of speech samples. These blocks may represent the content of registers or temporary storage locations, each element of which contains data representing the amplitude of a given speech sample.

Phase information is for the most part ignored or otherwise only indirectly accounted for by the method according to the invention. It is known that the human ear is substantially immune to inaccuracies in phase information in speech.

In accordance with the invention, incoming speech is sampled at a selected sampling rate, and the samples are combined into blocks, herein termed "input blocks," the samples in each input block representing the amplitude of the speech i§ signal for such sample. Each input block overlaps the preceding input block by a predetermined number of samples. The number of samples by which each successive input block exceeds or extends beyond the preceding input block is termed the overlap value or OV and is a function of the sampling rate and of the number of samples contained in an input block.

Normally, the sample values are normalized to a range suitable for subsequent processing. (Automatic gain control may be employed independently of the normalized values.) In a specific embodiment, a maximum pitch period of no more than 17 ms is assumed, and each input block contains a uniform number of samples, selected to be between 80 and 120, representing a nominal 10–15 ms segment of speech information. A 10 ms segment is considered time invariant for the purpose of speech, which has a nominal spectrum of information of 200 Hz to 4000 Hz.

The method of the invention normally begins with initializing of variables and memory locations, which are set in accordance with preselected initializing values (Step A). The values to be initialized include user-selectable parameters, such as the number of samples which will be contained in each input block, the value of overlap value OV and the speed control value SCV, which indicates the amount by which it is desired to speed up or slow down speech (Step B).

The speed control value SCV is typically expressed as a number of samples. If the SCV is selected to exceed the overlap value OV, the output signal will be slowed relative to the input signal. If the SCV is selected to be less than the OV value, the output signal will be speeded up relative to the input signal.

FIG. 3A illustrates three successive input blocks on a continuing time scale, illustrating the overlapping thereof. In accordance with the present invention, an output block is defined and typically comprises an input block of speech samples which is stored in storage means 22. A superimposition reference pointer P is placed at a location along the output block in accordance with the SCV value (Step C).

FIG. 3B illustrates the pointer P at a location on an output block which produces speeding up of the output speech. Were the pointer P at the OV line, the output speech would be provided at exactly the same speed as the input speech.

A search range of a selected number of samples SR to either side of the pointer is selected as a function of the pitch frequency of the speech (Step D). The search range is requited to be approximately equal to the maximum pitch frequency. The selection of a search range is a particular feature of the present invention, as it enables preservation of pitch without requiring superfluous computations which require excess computing capability and computation time.

An input block, such as input block I, is defined (Step E). The first N samples of the input block (FIG. 3A) then undergo best fit matching to the portion of the output block within the above-defined search range, preferably by means of an Average Magnitude Difference Function (AMDF) adapted to the present invention, in order that the pitch pulses of the input block and the output block match as nearly as possible. Once the desired match has been found the input and output blocks are superimposed (FIG. 3C) at the location providing the best match, thereby preserving the pitch without creating undesired discontinuity between output blocks (Step F). In accordance with a preferred embodiment of the invention, the AMDF calculates the absolute value of the difference between the input block and the output block for each of a plurality of different possible superimpositions within the predetermined search range, thus identifying the superimposition having the lowest difference so that it may be selected for use in the subsequent processes. Use of the AMDF is a particular feature of the invention which represents a significant advance over the art and a departure from the prior art which employs cross-correlation functions. Such prior art functions involve multiplications which require substantial computation capabilities and computation time. Use of the AMDF increases capabilities without sacrificing computation power, which for example gives the method according to the invention an inherent bandwidth advantage over the prior art. A description of an Average Magnitude Difference Function suitable for implementation in the present invention is found in *Digital Processing of Speech Signals,* by L. R. Rabiner and R. W. Schafer, pp. 149–150 (Prentice-Hall, 1978), the content of which is incorporated herein by reference.

The superimposed portions of the output block and the input block are combined by a desired weighting arrangement or factor W (FIG. 3C) so as to provide a smooth transition from the sample values of the output block to those of the input block (Steps G and H). A substantially linear ramp is a suitable weighting factor, as illustrated in FIG. 3C.

The weighted combination of the input block with the overlapping portion of the output block becomes a new or next output block, herein indicated as output block II and shown in FIG. 3D. Output block II is stored in storage means 22.

According to the invention, that portion of the output block I which did not overlap the input block is output for the DAC 18 (FIG. 1) (Step I).

It is to be appreciated that the difference between the location of the pointer and the location at which superimposition begins is a potential source of distortions if combined over several output blocks. Accordingly, signal processor 16 operates to store the information on this difference (Step J) and to position the pointer on the subsequent output block so as to compensate for this difference.

Reference is made to the Appendix for a detailed technical description illustrating a specific embodiment of the invention.

The invention has now been explained with reference to specific embodiments. Other embodiments will be apparent to those of ordinary skill in the relevant art. It is therefore not intended that the invention be limited, except as indicated by the appended claims.

APPENDIX

Contents:

1. Selected Source Code:

```
Line#  Source Line                                    Microsoft C Compiler Version 4.00

     1  #include <\msc\include\stdio.h>
     2  #include <\msc\include\math.h>
     3
     4  #define bl_length        320       /* 40 msec for samp. rate of 8 Khz */
     5  #define DT_OFF           2048
     6
     7  #define        sblocklen        80       /* size of search block is 10 ms
sec. */
     8  #define        srange           120      /* range of search is 15 msec */
     9
```

```
10  int     overlap ;
11  int     scf     ;
12
13  main(argc,argv)
14  int      argc    ;
15  char     *argv[] ;
16  {
17  FILE     *fpin   ;
18  FILE     *fpout  ;
19  FILE     *fopen();
20
21  int     head[256]       ;
22  char    fname[30]       ;
23
24  float      inblk[bl_length]       ;
25  float      outblk[bl_length]      ;
26
27  int     frcount ;
28  int     index   ;
29  int     pos     ;
30  int      center  ;
31
32  register        int      i       ;
33
34  float  step     ;
35  float  fmul     ;
36  float  smul     ;
37
38  /* check number of arguments */
39  if (argc != 2) {
40          printf("usage : flex <ils_file>\n") ;
41          exit(0) ;
42          }
43  /* check if the input file exist */
44  if ((fpin = fopen(argv[1],"rb")) == NULL){
45          printf("can't open %s \n" , argv[1] ) ;
46          exit(0) ;
47          }
48  /* read header of input ils file */
49  fread(head,sizeof(head),1,fpin) ;
50
51  /* check if input file is valid ils file */
52  if (head[62] != -32000 ) {
53          printf(" %s  is not ils sampled data file\n" , argv[1]);
54          exit(0) ;
55          }
56
57  /* get output file name */
58  printf("PLEASE ENTER OUTPUT FILE NAME  ==>");
59  scanf ("%s",fname) ;
60  /* check if is possible to open output file */
61  if ((fpout = fopen(fname,"wb")) == NULL) {
62          printf("can't open %s \n", fname);
63          exit(0);
64          }
65  /* copy input file header to output file */
66  fwrite(head,sizeof(head),1,fpout) ;
67
68
69  /* read the rate modification factor */
70  readfc() ;
71
72  /* initalize input and output blocks */
73  init(inblk,outblk,fpin) ;
74
75  frcount = 0 ;
76  pos = scf ;
77
78  /* loop until end of file */
79  while ( feof(fpin) == NULL ) {
80
81          readblk(inblk,fpin) ;
82
```

```
83          /* find index of minimum AMDF */
84         index = amdf(outblk,inblk,pos) ;
85         writeblk(outblk,index,fpout) ;
86
87          /* find the center of the common portion */
88          center = (bl_length - index)/2 ;
89
90          /*=========================*/
91         /* form new output block */
92          /*=========================*/
93
94          /* transfere first samples without any change */
95          for ( i = index ; i < center - 32 ; i ++ )
96                  outblk[i-index] = outblk[i] ;
97
98          /* applay weighting window to next 64 samples */
99          step = 1./64. ;
100         for ( i = center - 32 ; i < center + 32 ; i ++ ){
101                 fmul = 1. ;
102                 smul = 0. ;
103                 outblk[i - index] = outblk[i]*fmul + inblk[i - index]*sm
l ;
104                 fmul = fmul - step ;
105                 smul = smul + step ;
106                 }
107         /* transfere the rest of vector from input block */
108         for ( i = center + 32 ; i < bl_length ; i ++ )
109                 outblk[i] = inblk[i] ;
110
111         index = index - scf ;
112         pos = pos - index ;
113         index = index + scf ;
114          printf("%4d frames finished\n" , ++frcount ) ;
115         }
116  fclose(fpin) ;
117  fclose(fpout) ;
118
119  }
```

main Local Symbols

| Name | Class | Offset | Register |
|---|---|---|---|
| frcount . . . . . | auto | -0c38 | |
| smul. . . . . | auto | -0c36 | |
| fpout . . . . . | auto | -0c32 | |
| outblk. . . . . | auto | -0c30 | |
| index . . . . . | auto | -0730 | |
| pos . . . . . | auto | -072e | |
| fmul. . . . . | auto | -072c | |
| head. . . . . | auto | -0728 | |
| i . . . . . | auto | *** | si |
| step. . . . . | auto | -0526 | |
| center. . . . . | auto | -0522 | |
| fname . . . . . | auto | -0520 | |
| fpin. . . . . | auto | -0502 | |
| inblk . . . . . | auto | -0500 | |
| argc. . . . . | param | 0004 | |
| argv. . . . . | param | 0006 | |

```
120
121  static int      inb[bl_length]  ;
122
123  init(in,out,fp)
124  float  in[]     ;
125  float  out[]    ;
126  FILE   *fp      ;
127  {
128  register        int      i        ;
129
130  fread(inb,sizeof(inb),1,fp) ;
131  for ( i = 0 ; i < bl_length ; i ++ ) {
132          inb[i] = inb[i] - DT_OFF ;
```

```
133         in[i] = (float)inb[i]/DT_OFF ;
134         out[i] = in[i] ;
135         }
136 }
```

nit Local Symbols

| Name | Class | Offset | Register |
|---|---|---|---|
| i . . . . . | auto | *** | si |
| in. . . . . | param | 0004 | |
| out . . . . . | param | 0006 | |
| fp. . . . . | param | 0008 | |

```
137
138 readblk(w,fp)
139 float  w[]     ;
140 FILE   *fp     ;
141 {
142 register       int     i       ;
143 register       int     j       ;
144
145 /* shift input block overlap samples left */
146 for ( i = overlap , j = 0 ; i < bl_length ; i ++ , j ++ )
147         inb[j] = inb[i] ;
148
149 /* read next overlap samples */
150 i = fread(&inb[bl_length-overlap],overlap*2,1,fp) ;
151 if ( i == 0 ) exit(0) ;
152
153 /* convert the samples to integer format */
154 for ( i = bl_length - overlap ; i < bl_length ; i ++ )
155         inb[i] = inb[i] - DT_OFF ;
156
157 /* return output block */
158 for ( i = 0 ; i < bl_length ; i ++ )
159         w[i] = (float) inb[i]/DT_OFF ;
160 }
```

readblk Local Symbols

| Name | Class | Offset | Register |
|---|---|---|---|
| j . . . . . | auto | *** | di |
| i . . . . . | auto | *** | si |
| w . . . . . | param | 0004 | |
| fp. . . . . | param | 0006 | |

```
161
162 int    amdf(out,in,pos)
163 float  out[]   ;
164 float  in[]    ;
165 int    pos     ;
166 {
167
168 float  maxcorr ;
169 float  innerr  ;
170 float  outenr  ;
171 float  corr    ;
172
173 register       int     i       ;
174 register       int     j       ;
175
176 int    index   ;
177 maxcorr = 1000. ;        /* arbitrary large number */
178
179 /* loop over  all search range */
180 for ( i = (pos - srange/2) ; i < (pos + srange/2) ; i ++ ) {
181
182         /* compute amdf function between two vectors */
183         corr = 0 ;
184         for ( j = 0 ; j < sblocklen ; j ++ )
185                 corr += fabs(in[j] - out[j+i]) ;
```

```
186         if ( corr < maxcorr ) {
187                         maxcorr = corr ;
188                         index = i ;
189                         }
190         }
191  return(index) ;
```

amdf Local Symbols

| Name | Class | Offset | Register |
|---|---|---|---|
| corr. . . . . | auto | -0016 | |
| index . . . . . | auto | -0012 | |
| j . . . . . | auto | *** | di |
| i . . . . . | auto | *** | si |
| maxcorr . . . . . | auto | -000c | |
| inener. . . . . | auto | -0008 | |
| outener . . . . . | auto | -0004 | |
| out . . . . . | param | 0004 | |
| in. . . . . | param | 0006 | |
| pos . . . . . | param | 0008 | |

```
192  }
193
194  writeblk(w,n,fp)
195  float  w[]     ;
196  int    n       ;
197  FILE   *fp     ;
198  {
199  register       int     i       ;
200
201  int    out[bl_length];
202  for ( i = 0 ; i < n ; i ++ )
203         out[i] = (int) (w[i]*DT_OFF + DT_OFF) ;
204  fwrite(out,n*2,1,fp) ;
205  }
```

writeblk Local Symbols

| Name | Class | Offset | Register |
|---|---|---|---|
| i . . . . . | auto | *** | si |
| out . . . . . | auto | -0280 | |
| w . . . . . | param | 0004 | |
| n . . . . . | param | 0006 | |
| fp. . . . . | param | 0008 | |

```
206
207  readfc()
208  {
209  int    fact    ;
210
211  printf("enter factor <0..7> : ") ;
212  scanf("%d" , &fact ) ;
213  switch ( fact ) {
214         case    0 :             /* speed up by 0.5 */
215                 overlap = 240 ;
216                 scf = 120 ;
217                 break ;
218         case    1 :             /* speed up by 0.75  */
219                 overlap = 160 ;
220                 scf = 120 ;
221                 break ;
222         case    2 :             /* speed up by 0.875 */
223                 overlap = 160 ;
224                 scf = 140 ;
225                 break ;
226         case    3 :             /* speed up by 0.666667 */
227                 overlap = 180 ;
228                 scf = 120 ;
229                 break ;
230         case    4 :             /* slow by factor of 1.25 */
231                 overlap = 96 ;
```

```
232                 scf = 120 ;
233                 break ;
234         case    5 :             /* slow by factor of 1.5 */
235                 overlap = 80 ;
236                 scf = 120 ;
237                 break ;
238         case    6 :             /* slow by factor of 1.75 */
239                 overlap = 64 ;
240                 scf = 112 ;
241                 break ;
242         case    7 :             /* slow by factor of 2 */
243                 overlap = 64 ;
244                 scf = 128 ;
245                 break ;
246         default :
247                 printf("illegal comp. factor\n") ;
248                 exit(0) ;
249         }
250 }
```

```
readfc  Local Symbols

Name                                Class     Offset     Register

fact. . . . . . . . . . . . . . . . auto      -0002


Global Symbols

Name                                Type                Size     Class     Offset

amdf. . . . . . . . . . . . . . . . near function       ***      global    038b
exit. . . . . . . . . . . . . . . . near function       ***      extern     ***
fabs. . . . . . . . . . . . . . . . near function       ***      extern     ***
fclose. . . . . . . . . . . . . . . near function       ***      extern     ***
fopen . . . . . . . . . . . . . . . near function       ***      extern     ***
fread . . . . . . . . . . . . . . . near function       ***      extern     ***
fwrite. . . . . . . . . . . . . . . near function       ***      extern     ***
inb . . . . . . . . . . . . . . . . struct/array        640      static    0000
init. . . . . . . . . . . . . . . . near function       ***      global    027d
main. . . . . . . . . . . . . . . . near function       ***      global    0000
overlap . . . . . . . . . . . . . . int                   2      common     ***
printf. . . . . . . . . . . . . . . near function       ***      extern     ***
readblk . . . . . . . . . . . . . . near function       ***      global    02e8
readfc. . . . . . . . . . . . . . . near function       ***      global    047b
scanf . . . . . . . . . . . . . . . near function       ***      extern     ***
scf . . . . . . . . . . . . . . . . int                   2      common     ***
writeblk. . . . . . . . . . . . . . near function       ***      global    0427

Code size = 052d (1325)
Data size = 00e5 (229)
Bss size  = 0280 (640)

No errors detected
```

I claim:

1. A method for processing time domain speech signals containing speech information to vary the rate of reproduction thereof without change of pitch comprising:

superimposing partially overlapping blocks of speech samples in a manner such that periodicity of pitch is maintained, the extent of superimposition being a function of a desired variance in rate of reproduction of said speech information;

applying an average magnitude difference of function to the overlapping blocks at each superimposition in a search range to determine a best match;

fixing a precise superimposition of the overlapping blocks in accordance with the best match; and applying a smoothed weighted function to the superimposed portion of the overlapping blocks.

2. The method according to claim 1 wherein said superimposing step comprises defining a search range over which said best match is sought, said search range being a function of pitch frequency of said speech information.

3. A method for varying rate of reproduction of speech information comprising the steps, for each frame of speech information, of:

receiving speech samples representative of time domain speech information sufficient to form a frame, the number of speech samples being determined by a desired rate of reproduction, and duration of the frame being fixed;

placing said speech samples in an input block having a first portion and at least a second portion;

establishing a first search range and a second search range on an output block, specifically a high search range and a low search range, an output block being a block which was processed directly prior to said frame;

designating a first portion of the samples of said input block as a high search representation;

additively comparing between said input block and said output block for all samples between said low search range and said high search range according to an average magnitude difference function to obtain a point of maximum cross correlation of said output block with said input block;

at the point of maximum cross correlation; combining overlapping segments of said input block with said output block according to a preselected smoothing weighting function to form a next output block; and providing said next output block as information to an output utilization means, said next output block also becoming said output block for a next iteration.

4. The method according to claim 1 wherein said smoothing weighting function is a ramped window function having a maximum combination at commencement of said input block and minimum combination at termination of said output block.

5. A method for varying the rate of reproduction of a time domain speech signal containing speech information without changing pitch comprising the steps for each frame of speech of:

capturing input time domain speech samples in a unit defined by said frame at a fixed sample rate, the number of samples per frame being a function of a desired speech change factor;

forming an input block from at least a portion of a first said frame;

comparing said input block with a prior-processed block by means of a multiplierless average magnitude difference function to obtain a time relation of maximum correlation at a preselected rate of reproduction indicated by a point in time where the average magnitude difference between said input block and said prior-processed block is of minimum magnitude;

adding said input block to said prior-processed block in overlap at said point of maximum correlation to obtain an intermediate block having a common portion between said input block and said prior processed block;

weighting said common portion by a smoothing window function to obtain an output block for output as well as for use as a next subsequent prior-processed block with a next subsequent input block; and providing with said output block to an output utilization means for reproduction of a segment of said speech signal at a rate differing from said input rate and without a change of pitch.

6. A system for processing time domain speech signals containing speech information to vary rate of reproduction thereof without changing pitch comprising:

means for superimposing partially overlapping blocks of speech samples in a manner such that periodicity of pitch is maintained, the extent of superimposition being a function of a desired variance in rate of reproduction of said speech information;

means for applying an average magnitude difference function to the overlapping blocks at each superimposition in a search range to determine a best match;

means for fixing a precise superimposition of the overlapping blocks in accordance with the best match; and means for applying a smoothed weighting function to the superimposed portion of the overlapping blocks.

7. The system according to claim 6 wherein said superimposing means includes means for applying a smoothed weighting function to the superimposed portion of the overlapping blocks.

8. The system according to claim 7 wherein said superimposing means further comprises means defining a search range over which said best match is sought, said search range being a function of pitch frequency of said speech information.

9. The system according to claim 6 wherein said superimposing means comprises means defining a search range over which said best match is sought, said search range being a function of pitch frequency of said speech information.

* * * * *